US007563970B2

(12) United States Patent
Laukat et al.

(10) Patent No.: US 7,563,970 B2
(45) **Date of Patent: *Jul. 21, 2009**

(54) WOODWIND INSTRUMENT

(75) Inventors: Sheryl Laukat, Sandy, UT (US); Tevis Laukat, Sandy, UT (US)

(73) Assignee: Cannonball Musical Instruments, Sandy, UT (US)

( * ) Notice: Subject to any disclaimer, the term of this patent is extended or adjusted under 35 U.S.C. 154(b) by 278 days.

This patent is subject to a terminal disclaimer.

(21) Appl. No.: 11/306,146

(22) Filed: Dec. 16, 2005

(65) Prior Publication Data

US 2007/0277666 A1 Dec. 6, 2007

Related U.S. Application Data

(60) Provisional application No. 60/636,560, filed on Dec. 16, 2004.

(51) Int. Cl.
*G10D 9/04* (2006.01)

(52) U.S. Cl. ..... 84/385 R; 84/380 R

(58) Field of Classification Search ..... 84/385 R, 84/380 R, 382, 383 R, 387 R
See application file for complete search history.

(56) References Cited

U.S. PATENT DOCUMENTS

| | | | | |
|---|---|---|---|---|
| 59,204 | A | 10/1866 | Fiske | |
| 1,024,771 | A | 4/1912 | Glass | |
| 1,632,008 | A | 6/1927 | Lemm | |
| 1,716,929 | A | 6/1929 | Packan | |
| 1,828,389 | A | 10/1931 | Calvani | |
| 1,873,184 | A | 8/1932 | Calvani | |
| 2,033,774 | A | 3/1936 | Loomis | |
| 2,055,382 | A | 9/1936 | Loomis | |
| 2,151,337 | A | 3/1939 | Selmer | |
| 2,501,388 | A * | 3/1950 | Holland | 84/400 |
| 2,555,980 | A | 6/1951 | Loney | |
| 2,846,917 | A | 8/1958 | Lefevre-Selmer | |
| 3,136,200 | A | 6/1964 | Levblanc | |
| 3,443,018 | A | 5/1969 | Krebs | |

(Continued)

OTHER PUBLICATIONS

"Selmer Balanced Action Saxophone." Don Mackrills Music Stop. 2004. <http://www.donmack.com/Selmer/SelmerBalancedAction.htm>.

(Continued)

*Primary Examiner*—Jeffrey Donels
*Assistant Examiner*—Jianchun Qin
(74) *Attorney, Agent, or Firm*—Advantia Law Group; Michael W. Starkweather; Jason P. Webb

(57) ABSTRACT

A method of improving the tonal characteristics of a woodwind instrument. The method includes identifying a position on the woodwind instrument, wherein placement of a tonal material thereto causes a lowering of overtone amplitude during play, by observing overtone characteristics during play; positioning the tonal material to the woodwind instrument; measuring the overtone amplitude; playing the woodwind instrument; and repositioning the tonal material to optimal overtone amplitude position; and attaching the tonal material to the woodwind instrument, at the optimal overtone amplitude position. The tonal material comprises one of the group consisting of: garnet, jasper, agate, aventurine, carnelian, citrine, fluorite, hematite, malachite, obsidian, onyx, tiger's eye, turquoise, unakite, moonstone, peridot, jade, alexandrite, amethyst, chalcedony, quartz, aquamarine, lolite, rhodolite, opal, topaz, tourmaline, tanzanite, diamond, emerald, sapphire, ceylon sapphire, ruby, woodwind, other metals, and combinations thereof.

17 Claims, 8 Drawing Sheets

U.S. PATENT DOCUMENTS

| | | | | | |
|---|---|---|---|---|---|
| 3,635,117 | A | | 1/1972 | Nagao | |
| 3,657,464 | A | | 4/1972 | Pascucci | |
| 3,763,737 | A | * | 10/1973 | Sandner | 84/384 |
| 3,863,540 | A | | 2/1975 | Carree | |
| 3,865,005 | A | | 2/1975 | Carree | |
| 4,041,827 | A | | 8/1977 | Daglis | |
| 4,148,242 | A | | 4/1979 | Wiehr et al. | |
| 4,250,791 | A | | 2/1981 | Tairadate | |
| 4,453,445 | A | | 6/1984 | Todd | |
| 5,027,685 | A | | 7/1991 | Lenz | |
| D374,027 | S | | 9/1996 | Lee | |
| 5,644,095 | A | | 7/1997 | Davidson | |
| 5,900,562 | A | | 5/1999 | Smeding | |
| D411,565 | S | | 6/1999 | Lee | |
| 5,965,832 | A | | 10/1999 | Davidson | |
| D416,586 | S | | 11/1999 | Landuer | |
| 5,990,398 | A | | 11/1999 | Nonaka | |
| 6,015,946 | A | | 1/2000 | Yamaryo | |
| 6,034,312 | A | * | 3/2000 | Lubell et al. | 84/384 |
| 6,225,541 | B1 | | 5/2001 | Kodera et al. | |
| 6,265,649 | B1 | | 7/2001 | Smeding | |
| 6,384,306 | B1 | | 5/2002 | Hsich | |
| 6,664,456 | B2 | * | 12/2003 | Momchilovich | 84/400 |
| 6,852,917 | B2 | * | 2/2005 | McAleenan | 84/380 R |
| 7,335,831 | B2 | * | 2/2008 | Laukat et al. | 84/387 R |
| 2002/0166434 | A1 | | 11/2002 | Liu | |
| 2002/0178892 | A1 | * | 12/2002 | Lim | 84/384 |

OTHER PUBLICATIONS

"Welcome to Carl's Professional Band Instrument Repair." Carl's Professional Band Instrument Repair. 2005. <http://www.carlsproband.com/services/index.php>.

"iStockphoto.com : saxophone2." iStock International, Inc. 2005. <http://www.istockphoto.com/file_closeup/objects/musical_instruments/80692_saxophone2.php?id=80692>.

"Tech Topics: Interesting Questions . . . " CyberSax. <http://www.cybersax.com/QA/Q&A_prosthetics.html>.

"Selmer MK VI Alto Sax Saxophone." Zachary Music. 2002. <http://www.zacharymusic.com/Zachary_Music/ZAS750Lpics.htm>.

"ZeuS ZAS Alto Saxophone Intermediate." Colorado Brass and Woodwinds. 2004. <http://www.co-bw.com/ZAS%20650%20Alto%20Sax%20CBAW.htm>.

"Alto Saxophone Index." Pro Winds. 2005. <http://www.prowinds.com/prowinds_web_2000/instruments/saxophones/index_alto.htm>.

"Soprano Saxophone Index." Pro Winds. 2005. <http://www.prowinds.com/prowinds_web_2000/instruments/saxophones/index_soprano.htm>.

"Tenor Saxophone Index." Pro Winds. 2005. <http://www.prowinds.com/prowinds_web_2000/instruments/saxophones/index_tenor.htm>.

"Baritone Saxophone Index." Pro Winds. 2005. <http://www.prowinds.com/prowinds_web_2000/instruments/saxophones/index_baritone.htm>.

"Saxophones—Band and Musical Instruments." Dominic's Music—Band and Musical Instruments. <http://www.dominicsmusic.com/searchResult.php?group_id=4>.

"Dave Guardala Saxophones." Sax.Co.UK. 2005. <http://www.saxophones.co.uk/index2.html>.

"Conn." A Brief Outline of the Origins of Orchestral Saxophones in F & C. May 2005. <http://web.onetel.com/-gcwoodward/02conn.htm>.

"Yanagisawa Saxophone Necks (Bocals) from Eltham Woodwind and Brass." Eltham Woodwind and Brass. <http://www.elthamwoodwind.com.au/yanagisawa/bocal.html>.

"Saxophone Necks by Peter Ponzol." Peter Ponzol: Handcrafted Saxophone Products. <http://www.peterponzol.com/neck_info/neck_information.htm>.

"PM Woodwind Repair: Saxophone Repair, Used Saxophones, Selmer, Mark VI, Paul Masli . . . " PM Woodwind. <http://www.prnwoodwind.com/instruments.cfm?categoryid=61>.

"Selmer (Paris) Serie III Polished Brass, Matte lacquered Alto saxophone: Neck from Top." SaxForte. <http://www.saxforte.com/saxophones/Eb_Alto/Eb_Alto_Selmer_Paris_/Serie_III_Alto/Serie_III_Clear_Alto/s3a9.JPG>.

"The Gloger Crook." Stephen Howard Woodwind Instrument Repairs & Restoration. <http://www.shwoodwind.co.uk/Buying/Gloger.htm>.

"Unison Saxophone Necks." Hollywoodwinds. <http://www.unisonsaxophone.com/necks.html>.

"Home / Musikinstrumente / Orchesterinstrumente / Holzblasinstruments / Saxophone / G1." Yamaha Deutschland. <http://www.yamaha_europe.com/yamaha_europe/germany/10_musical_instruments/20_orchestra/10_woodwind/60_saxophones/50_saxophones._necks/G1/index.html/G>.

"The Collection of H.N. White Instruments", H.N. White. <http://www.hnwhite.com/Instruments.htm>.

"King Liberty Trumpet No. 1050: Picture 3 With Mini", H.N. White. <http://www.hnwhite.com/King/My%20Trumpets/Liberty%20Trumpet%20With%20Mini%20Trumpet%20Gold.jpg>.

"Trumpets and Cornets from Dave Ballard, Isle of Wight." David Ballard. <http://www.daveballard.co.uk/trumpets.htm>.

"Trumpet." Azerimusic. <http://www.azerimusic.net/old/lazim/back/pic/trumpet.jpg>.

"trumpet." Music at Virginia Tech. <http://www.music.vt.edu/musicdictionary/text/images/trumpet.jpg>.

"Trumpet." CentralSource.com. <http://www.centralsource.com/blender/intheworks/trumpet.jpg>.

"Dave's Bach Trumpet Page." Electrotheremin.com. <http://www.electrotheremin.com/DS001.html>.

"ZeuS Bb Trumpet, Olympus, C Trumpet, Guarnerius." Colorado Brass and Woodwinds. <http://www.co-bw.com/Trumpet%20Main%20CBAW.htm>.

"Trumpet." Resonans Musikk. <http://www.korpinstrumenter.no/Prislister/Trumpet1.jpg>.

"Brass Instruments—J. Mansfield Trumpets—Sheet Music Instruments Accessories." MusicCity.com <http://www.musicity.com/brass-7.html>.

"Ferguson Music at Hornguys.com—Fine Musical Instruments." Hornguys.com. <http://www.hornguys.com/hornsinstock.htm>.

"Zephyr and Zephyr Special." Zephyr and Zephyr Special Models. <http://www.saxpics.com/king/zephyr.htm>.

* cited by examiner

WOODWIND INSTRUMENT

This application claims benefit of U.S. provisional patent Ser. No. 60/636,560, filed on 16 Dec. 2004, by Sheryl Laukat and Tevis Laukat, entitled Saxophone, which is herein incorporated by reference.

BACKGROUND OF THE INVENTION

1. Field of the Invention

The present invention relates generally to woodwind instruments and, more particularly, to woodwind instruments with a tonal material attached thereto to achieve improved tonal characteristics.

2. Description of the Related Art

Woodwind instruments are generally those in which sound is produced by blowing through a mouthpiece against an edge or a vibrating reed, and which the pitch is varied by opening or closing holes in the body of the instrument. Woodwind instruments differ from brass instruments in that generally the sound for brass instruments is produced by vibration of the lips as the player blows into a tubular resonator. Brass instruments need not be made of brass, and woodwinds need not be made of wood. Woodwinds may even be made of brass, as is, for example, the saxophone. Some examples of woodwind instruments include the saxophone, oboe, piccolo, basset horn, clarinet, bassoon, and the like.

Woodwinds typically have an inherent problem with maintaining the correct pitch. This problem is especially inherent in the saxophones. As the instrument ascends the scale, it deviates from its optimum pitch level. This deviation represents itself by becoming more sharp (i.e., at higher frequency than is desired). B flat tenor saxophones, for example, generally begin to deviate at F sharp (at the fifth line treble clef or 329.6 Hz, concert E) and then reach the highest point of deviation at a B above the staff (440 Hz, concert A). Many people, especially those who have been musically trained, are capable of detecting a difference in frequency between two separate sounds which is as little as 2 Hz.

Various instruments are more unstable than others. For example, the saxophone is more difficult to play as they are slightly unstable when played. That is, many notes will deviate a small amount from the desired pitch level (i.e., frequency) even though the correct keys are being depressed. As such, the saxophone player must adjust the pitch by altering their blowing technique to force the saxophone into the proper pitch.

The general configuration of the various instruments categorized as saxophones has not changed since its inception in the mid 1800's. For example, the tenor saxophone includes a U-shaped horn with various keys along the horn that are used to selectively cover tone holes in the saxophone. Each key is operated by depressing a lever or key against the tone hole. Some of the keys have conventionally included an insert formed from mother of pearl. The mother of pearl inserts were provided for decorative purposes and to provide a material that generally maintains its luster after extended use and subsequent wear, although mother of pearl does wear out eventually, whereas, brass keys tend to tarnish and actually physically erode over time.

Accordingly, Leblanc has disclosed, in U.S. Pat. No. 3,136,200, a musical wind instrument of the open tube type such as a saxophone having upstream and downstream ends, the combination comprising a hollow body having a plurality of tone holes therein substantially aligned axially of said body, alternate ones of said tone holes being of small diameter relative to the adjacent tone-holes, a plurality of tone hole closure members, one for each of said tone holes, pivot mounting means mounting said tone hole closure members from said body for pivoting independently of one another, means normally maintaining all of said tone hole covers in raised hole open position, and means including one-way drive means interconnecting all of the closure members for said relatively small tone holes such that movement of any one of said small tone hole closure members to hole closing position effects urging of all of said small tone hole closure members upstream thereof to hole closing position, all small tone hole closure members downstream thereof remaining in raised hole open position. The patent further discloses that the saxophone can have finger pieces faced with mother-of-pearl.

Another example of a saxophone is disclosed in U.S. Pat. No. 3,863,540 to Carree. This patent discloses a saxophone having a key with an integral first lever extending outwardly therefrom, and that is pivotally mounted at an end remote from the key. A stop, disposed on a side of the saxophone opposite the key, has an integral second lever extending in a direction opposite the first lever and is pivotally mounted at an end remote from said stop. A third lever, coaxially mounted and commonly actuated with the second lever has an end portion juxtaposed the key. The key engages the third lever in operation to pivot the second lever to actuate the stop.

More recently, a saxophone is disclosed in U.S. Patent Application Publication No. 2002/0166434 by Liu. This application discloses a saxophone with a main body, a neck, a treble connection set, a connection rod, and a link set. The main body has a high G hole and a high F sharp hole. A high G button and a high G cover are connected by the connection rod. The neck has a treble hole. A treble cover is disposed on the neck. A helical tube is connected to the treble cover to surround the neck. A treble button is disposed on a lower end of the treble connection set. The treble button has a groove. A high F sharp button and a high F sharp cover are connected by the link set.

Saxophones are also the subject of several design patents, such as, for example U.S. Patent Nos. D419586 to Kuo, D411565 to Lee, and D374027 to Lee.

U.S. Pat. No. 6,664,456 to Momchilovich discloses resilient material and/or rubber O-rings that are placed at various predetermined locations to reduce unwanted sympathetic vibrations on musical instruments and firearms. This may improve the performance and sound of musical instruments and make them easier to play. The resilient material disclosed in this patent include rubber O-rings.

Further, U.S. Pat. Nos. 5,965,832 and 5,644,095 to Davidson disclose an improvement to the tone and responsiveness of brass instruments that is achieved by holding pre-shaped pieces of damping material, preferably a waxy, hot-melt adhesive, pressed against surfaces of the instrument tubing sections such as valve casings and tubing sections at particular locations, to reduce sympathetic vibrations of the instrument structure.

U.S. Pat. No. 59,204 to Fiske discloses the interposing of rubber or another suitable elastic substance between the attachments of the main pipe with the bell of a wind instrument.

U.S. Pat. No. 3,635,117 to Nagao discloses a ring fixing structure for a woodwind musical instrument. Rings are fixed around the elongated hollow bodies of the woodwind musical instrument, such as their joints and bell edge for reinforcing and ornamental purposes, grooves are formed, respectively, in opposite portions of the elongated hollow bodies and rings, and an adhesive of hot-melt-type is inserted and disposed in the grooves.

In addition to the above-mentioned problems, there exists a need to improve the inherent timbre problems of woodwind instruments, such as saxophones. That is, there exists a need to improve tonal consistency and evenness throughout the range of notes playable on a particular saxophone.

There is also a need to improve the tone quality, focus, clarity, character, warmth, centering, and depth of sound produced by a woodwind instrument.

What is needed is a woodwind instrument that solves one or more of the problems described herein and/or one or more problems that may come to the attention of one skilled in the art upon becoming familiar with this specification.

SUMMARY OF THE INVENTION

The present invention has been developed in response to the present state of the art, and in particular, in response to the problems and needs in the art that have not yet been fully solved by currently available woodwind instruments. According to one embodiment, the present invention has been developed to provide a woodwind instrument with improved tonal characteristics, which includes a body tube having at least one tone hole; and a tonal material attached to the woodwind instrument.

According to one embodiment, the woodwind instrument may further include a key mechanism attached to said body, wherein the key mechanism may control opening of the tone hole. The tonal material may be attached to the key mechanism.

In yet another embodiment, the tonal material may be attached to the body tube.

In still another embodiment, the tonal material may be in the general shape of an oval.

According to a further embodiment, the body tube may include a neck, and the tonal material may be attached to the neck. The neck may include a tone rich surface along which a tone travels, and the tonal material may be attached on the tone rich surface. The tone rich surface may be located along an outwardly-facing surface of the neck, and the tonal material may be attached on the outwardly-facing surface. The neck may include a mouthpiece area for attachment to a mouthpiece, the tonal material may include an apex, and the tonal material may be attached such that the apex is positioned toward the mouthpiece area along an axis of the neck.

The tonal material may be one selected from the group consisting of: garnet, jasper, agate, aventurine, carnelian, citrine, fluorite, hematite, malachite, obsidian, onyx, tiger's eye, turquoise, unakite, moonstone, peridot, jade, alexandrite, amethyst, chalcedony, quartz, aquamarine, lolite, rhodolite, opal, topaz, tourmaline, tanzanite, diamond, emerald, sapphire, ceylon sapphire, ruby, pumice, tungsten carbide, steel, silicon carbide, boron carbide, strontium titanate, emery, crystolon, corundum, combinations thereof, and the like.

The woodwind instrument may be any known in the art, such as one selected from the group consisting of: arghul, aulochrome, basset horn, clarinet, E-flat clarinet, alto clarinet, bass clarinet, contra-alto clarinet, contrabass clarinet, launeddas, mijwiz, rothphone, sarrusophone, saxophone, soprillo, sopranino saxophone, soprano saxophone, alto saxophone, tenor saxophone, C melody saxophone, baritone saxophone, bass saxophone, contrabass saxophone, subcontrabass saxophone, tubax, tarogato, bassanelli, bassoon, contrabassoon, bombarde, duduk, dulcian, dulzania, guan, heckelphone, piccolo heckelphone, hojok, mizmar, nadaswaram, oboe, piccolo oboe, oboe d'amore, English horn, oboe da caccia, racket, shawm, shehnai, suona, surnay, tromboon, trompeta china, zurna, bagpipes, cornamuse, crumhorn, hirtenschalmei, kortholt, rauschpfeife, bansuri, flute, fife, piccolo, Western concert flute, alto flute, bass flute, contrabass flute, ryuteki, hocchiku, kaval, ney, quena, shakuhachi, flageolet, gemshorn, ocarina, recorder, tin whistle, penny whistle, tonette, and the like.

According to one embodiment, the tonal material may be attached with an adhesive. The adhesive may include a polymer. The adhesive may include contact cement. The tonal material may be attached by threads, or other mechanical means.

According to a further embodiment, the present invention includes a method of improving the tonal characteristics of a woodwind instrument, including the step of attaching a tonal material to the woodwind instrument.

In still a further embodiment, the woodwind instrument may include a body tube having at least one tone hole and a key mechanism attached to said body tube, wherein the step of attaching the tonal material includes attaching the tonal material to at least one of the group selected from: the body tube and the key mechanism.

In yet a further embodiment, the body tube may include a neck, and the step of attaching the tonal material may include attaching the tonal material to the neck. The tonal material may be in the general shape of an oval with a major axis, the neck may include a mouthpiece area for attachment to a mouthpiece, and the step of attaching the tonal material may include attaching the tonal material such that the major axis is somewhat parallel with an axis of the neck.

In another further embodiment, the method may further include the step of applying an adhesive to one of the group consisting of: the tonal material, the body tube, the key, and combinations thereof.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention can be practiced without one or more of the specific features or advantages of a particular embodiment. In other instances, additional features and advantages may be recognized in certain embodiments that may not be present in all embodiments of the invention.

These features and advantages of the present invention will become more fully apparent from the following description and appended claims, or may be learned by the practice of the invention as set forth hereinafter.

BRIEF DESCRIPTION OF THE DRAWINGS

In order for the advantages of the invention to be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION OF THE INVENTION

Figure 1:
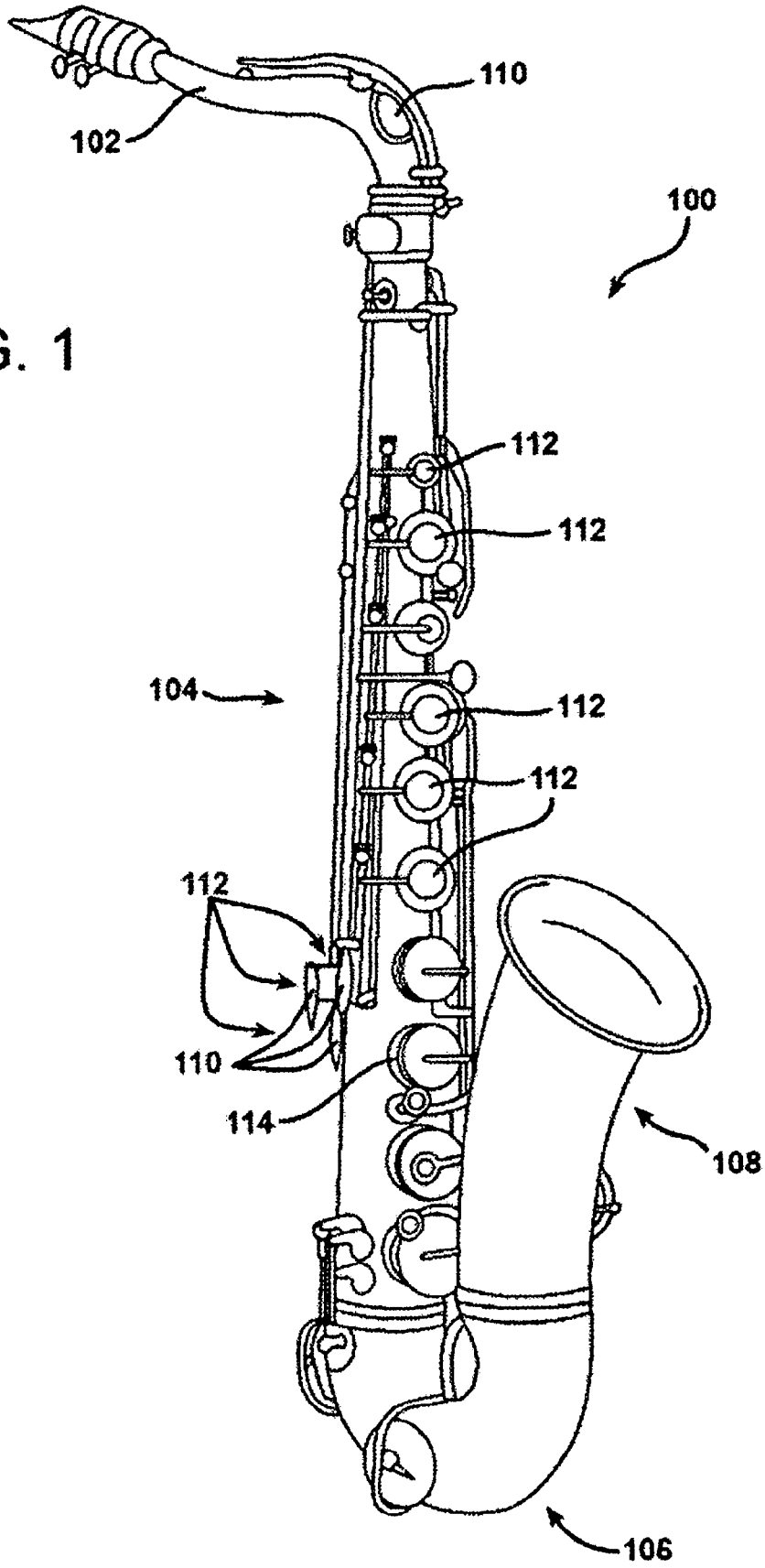
FIG. 1 illustrates a side perspective view of a woodwind instrument according to one embodiment of the present invention.

For the purposes of promoting an understanding of the principles of the invention, reference will now be made to the exemplary embodiments illustrated in the drawings, and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would occur to one skilled in the relevant art and having possession of this disclosure, are to be considered within the scope of the invention.

Reference throughout this specification to "one embodiment," "an embodiment," or similar language means that a particular feature, structure, or characteristic described in connection with the embodiment is included in at least one embodiment of the present invention. Thus, appearances of the phrases "one embodiment," "an embodiment," and similar language throughout this specification may, but do not necessarily, all refer to the same embodiment, different embodiments, or component parts of the same or different illustrated invention. Additionally, reference to the wording "an embodiment," or the like, for two or more features, elements, etc. does not mean that the features are related, dissimilar, the same, etc. The use of the term "an embodiment," or similar wording, is merely a convenient phrase to indicate optional features, which may or may not be part of the invention as claimed.

Each statement of an embodiment is to be considered independent of any other statement of an embodiment despite any use of similar or identical language characterizing each embodiment. Therefore, where one embodiment is identified as "another embodiment," the identified embodiment is independent of any other embodiments characterized by the language "another embodiment." The independent embodiments are considered to be able to be combined in whole or in part one with another as the claims and/or art may direct, either directly or indirectly, implicitly or explicitly.

Finally, the fact that the wording "an embodiment," or the like, does not appear at the beginning of every sentence in the specification, such as is the practice of some practitioners, is merely a convenience for the reader's clarity. However, it is the intention of this application to incorporate by reference the phrasing "an embodiment," and the like, at the beginning of every sentence herein where logically possible and appropriate.

As used herein, "comprising," "including," "containing," "is," "are," "characterized by," and grammatical equivalents thereof are inclusive or open-ended terms that do not exclude additional, unrecited elements or method steps. "Comprising" is to be interpreted as including the more restrictive terms "consisting of" and "consisting essentially of."

As used herein, "tonal material" may include any solid material capable of being attached to a substrate. The tonal material need not have a relative density greater than that of the instrument, so long as. For example, a tonal material may include pumice, which may have a density of less than that of water.

As used herein, "tonal characteristics" includes any of the characteristics such as timbre, pitch, tonal consistency, evenness, tone quality, focus, clarity, character, warmth, centering, and/or depth of sound.

As used herein, "tonal material" includes any material that affects one or more of the tonal characteristics when placed on an instrument.

As used herein, "body" includes any part of the body of the woodwind instrument used for the generation of sound, or the surface along which, or through which, the sound resonates and/or travels. That is, the body will include the structure through which the forced air and/or sound vibrations flow. The body may include, for example, the mouthpiece, the neck, the body tube, the valve(s), the bell, the bow, and the like. For example, if the woodwind instrument is a saxophone, the body of the instrument includes the reed, neck, body tube, bow and bell.

As used herein, "key mechanism" includes the key and the pieces that are coupled to the key to facilitate the opening and/or closing of a tone hole.

FIG. 1 illustrates a side perspective view of a woodwind instrument according to one embodiment of the present invention. In this illustration, the woodwind instrument is a saxophone 100, specifically, a tenor saxophone. The woodwind instrument includes a neck 102, a body tube 104, a bow 106, and a bell 108. Along the body tube 104, bow 106 and bell 108, there may be at least one tone hole 114. At least one key 112 may also be provided. The key 112 may be configured to control the opening and/or closing of the tone hole 114 when depressed. The keys 112 may be linked to tone hole covers through a key mechanism. In one embodiment, the tone holes 114 may be biased in the closed or open position, and the keys 112, when depressed, may be configured to open the tone holes 114 that are biased in a closed position, and/or close the tone holes 114 that are biased in an open position. There may be a series of tone holes 114 and keys 112. The series of tone holes 114 and keys 112 may be configured such that the depressing of keys 112 opens certain of the tone hole covers. For example, the low B and low B flat tone holes may be biased in an open position. Conversely, the low C sharp tone hole may be biased in a closed position.

A tonal material 110 may be placed on the woodwind instrument. As illustrated in FIG. 1, the tonal material 110 may be placed on the neck 102, body tube 104, bow 106, and/or bell 108 of the saxophone 100. Further, according to this illustrated embodiment, the tonal material 110 may be placed on the keys 112 of the saxophone 100. It is envisioned that the tonal material may be placed anywhere on the key mechanism. In the illustrated embodiment, the finger buttons that are depressed to actuate a particular tone hole are provided with stone as the tonal material 110. Further, the finger buttons finger buttons, right hand finger buttons, right hand side keys, lever buttons, and/or left hand palm keys may include a tonal material 110 such as a stone.

Figure 3:
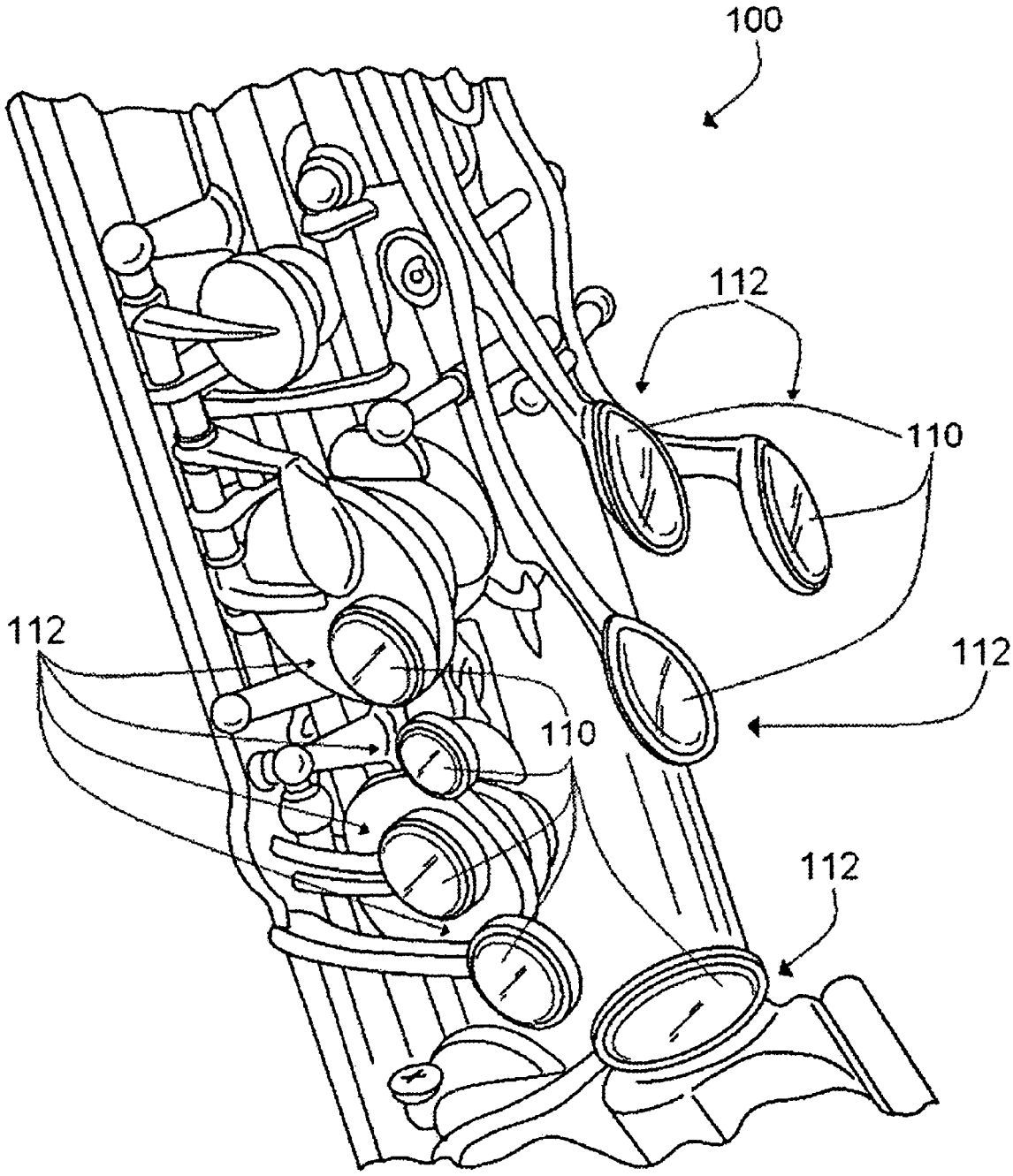
FIG. 3 illustrates a side perspective view of a portion of a woodwind instrument according to one embodiment of the present invention.

FIG. 3 further illustrates a tonal material 110 placed on keys 112 of a woodwind instrument 100. FIG. 3 illustrates a section of a woodwind instrument 100 which includes keys 112. Several types of keys 112 are illustrated. Tonal material 110 may be placed on the keys 112 in such a way that, when played, the user interfaces with the tonal material 110 when depressing the keys 112.

Figure 2:
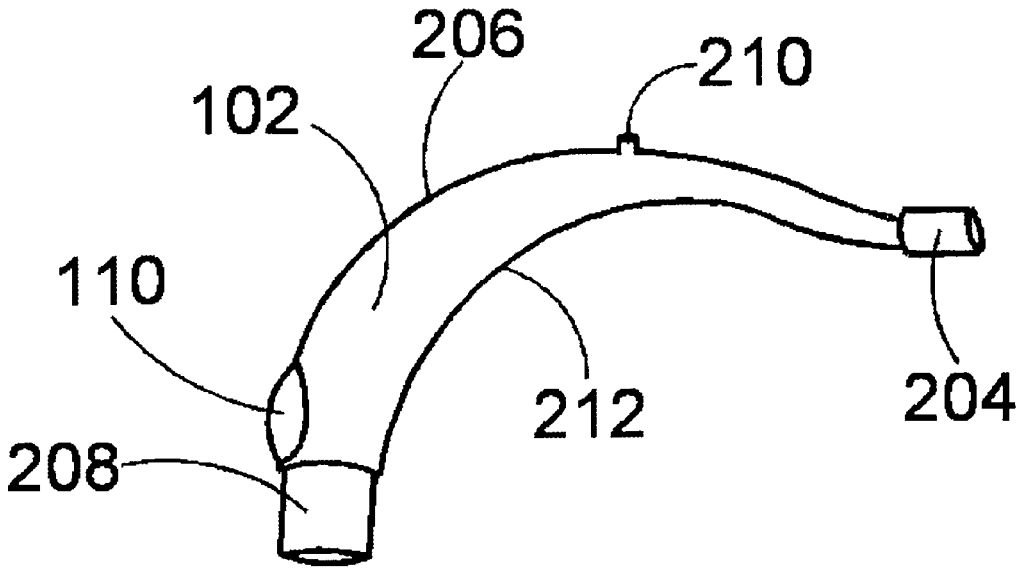
FIG. 2 illustrates a side perspective view of a neck of a woodwind instrument according to one embodiment of the present invention.

The tonal material 110 may be placed on the body of the woodwind. For example, the tonal material 110 may be placed on any of the parts, such as, for example, the neck 102, the body tube 104, the bow 106, and/or the bell 108. FIG. 2 illustrates one embodiment wherein the tonal material 110 is placed on the neck 202. In one embodiment, the tonal material 110 is placed on the neck 102 nearer to the section of the neck 102 that couples with the woodwind instrument, 208 (the tenon of the saxophone neck) than the mouthpiece section 204. The tonal material 110, according to one embodiment, is placed as near as possible to the coupling section of the neck (tenon) 208, but not on the coupling section 208. The neck 102 may be curved. Such a curved neck 102 may include an upper surface 206 and a lower surface 212. The upper surface 206 may be located along the curved neck 102 such that it is directed substantially away from the mouthpiece section 204. The lower surface 212 may be located along the curved neck 102 such that it is directed substantially toward the mouthpiece section 204. The upper surface 206 may include at least about 240° of the cross-sectional diameter of the neck 102. In another embodiment, the upper surface 206 may include at least about 180° of the cross-sectional diameter of the neck 102. In yet another embodiment, the upper surface 206 may include at least about 120° of the cross-sectional diameter of the neck 102. In still another embodiment, the upper surface 206 may include at least about 90° of the cross-sectional diameter of the neck 102.

The tonal material may be substantially oval in shape. The oval tonal material may include a major axis between two points on the tonal material that are the furthest apart. The tonal material may be placed on the neck in such a way that the major axis is substantially parallel to an axis of the neck.

Figure 4:
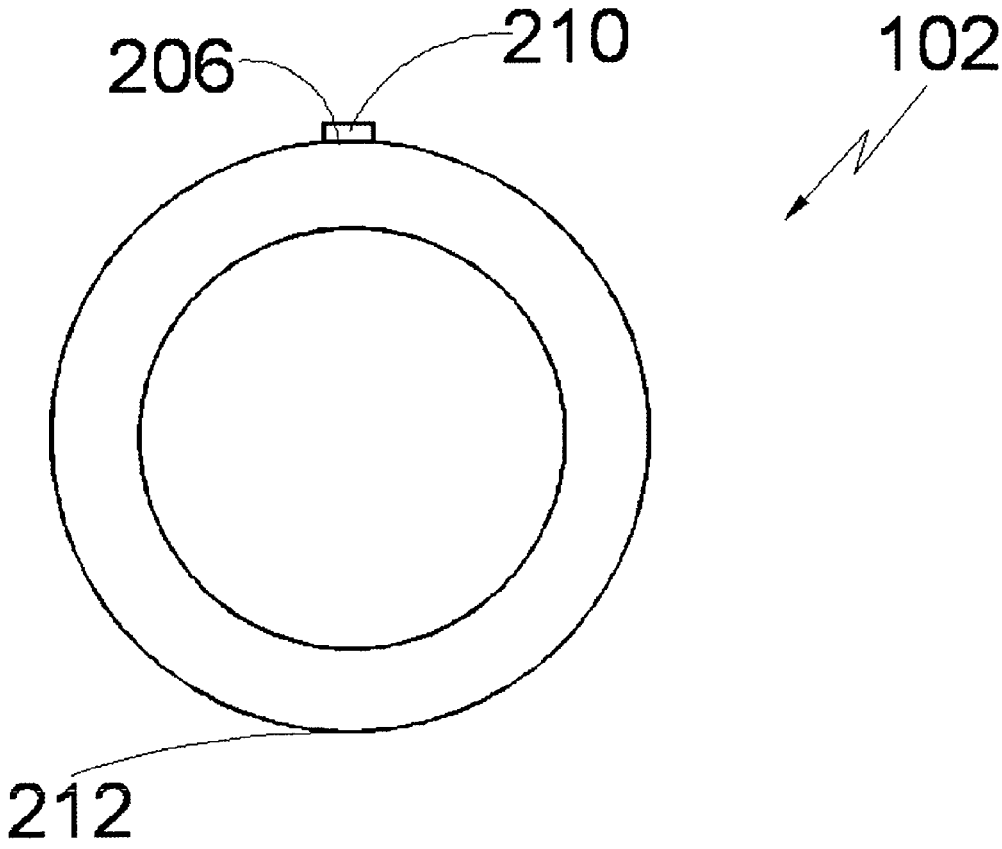
FIG. 4 illustrates a cross sectional view of a neck of a woodwind instrument according to one embodiment of the present invention.

The tonal material 110 may be placed on a section of any of the various body parts of the woodwind such that the tonal material affects any of the tonal characteristics of the woodwind instrument. It is believed, but not meant to be limiting, that placing the tonal material 110 along certain portions of the woodwind instrument alters any or all of the above characteristics. For example, FIG. 4 illustrates a cross section of the neck 102 that is perpendicular to an axis of the neck 102. The cross section view of the neck 102 includes the octave key tone hole 210. It is believed, but not meant to be limiting, that sound vibrations created by the reed travel linearly from the reed. Thus, if the neck 102 curves, it is believed that the sound vibrations travel more along the outer surface 206 of the neck 102 than they do along the inner surface 212 of the neck 102. According to one embodiment of the present invention, the tonal material 110 is placed on the outer surface 206 of the neck 102. In another embodiment, the tonal material 110 is placed on a surface of the neck 102 that is not an inner surface 212 of the neck 102.

In one embodiment, the woodwind instrument is a saxophone, and the tonal material is placed on the neck. The tonal material may be placed on a surface of the neck nearest to the tenon, and on a surface furthest from the player, and/or closest to the bell of the saxophone.

Figure 5:
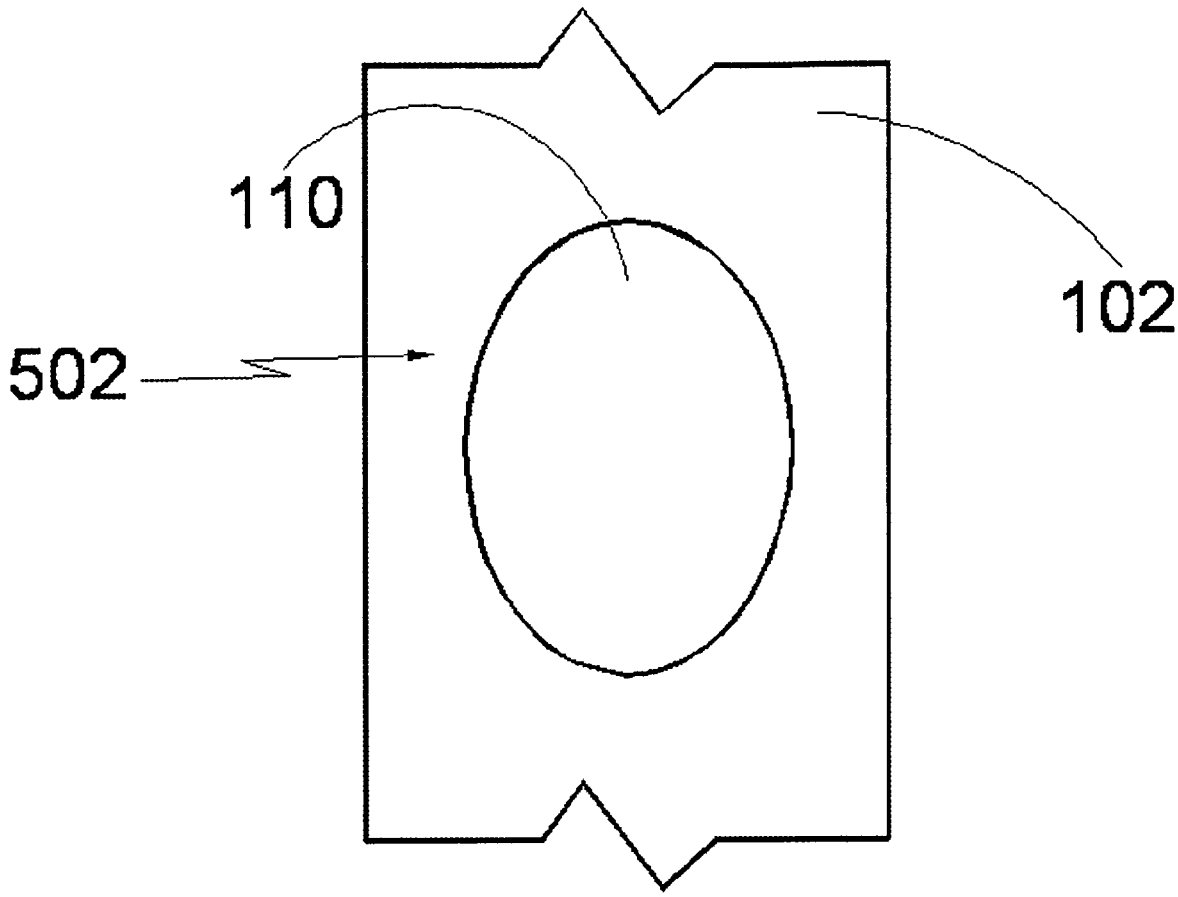
FIG. 5 illustrates a front plan view of a neck of a woodwind instrument according to one embodiment of the present invention.

According to yet another embodiment of the present invention, as illustrated in FIG. 5, the tonal material 502 may be substantially oval in shape, and may be attached to the neck 102. That is, the tonal material 502 may have an apex 110 that is narrower than the rest of the tonal material 502. According to one embodiment, the tonal material 502 may by placed such that the apex 110 is nearer to the mouthpiece section 204 than to the section 208 that couples to the remainder of the woodwind instrument. That is, when viewed from the front, the apex 110 points upwardly. It is believed, but not meant to be limiting, that the section of a curved neck 102 along the outer diameter 404 of the curve of the neck 102 near the section 208 that couples to the remainder of the woodwind instrument includes at least one node for at least one note played by the woodwind instrument. It is further believed that by placing the tonal material 502 in this section may improve at least one of the tonal characteristics.

Figure 6:
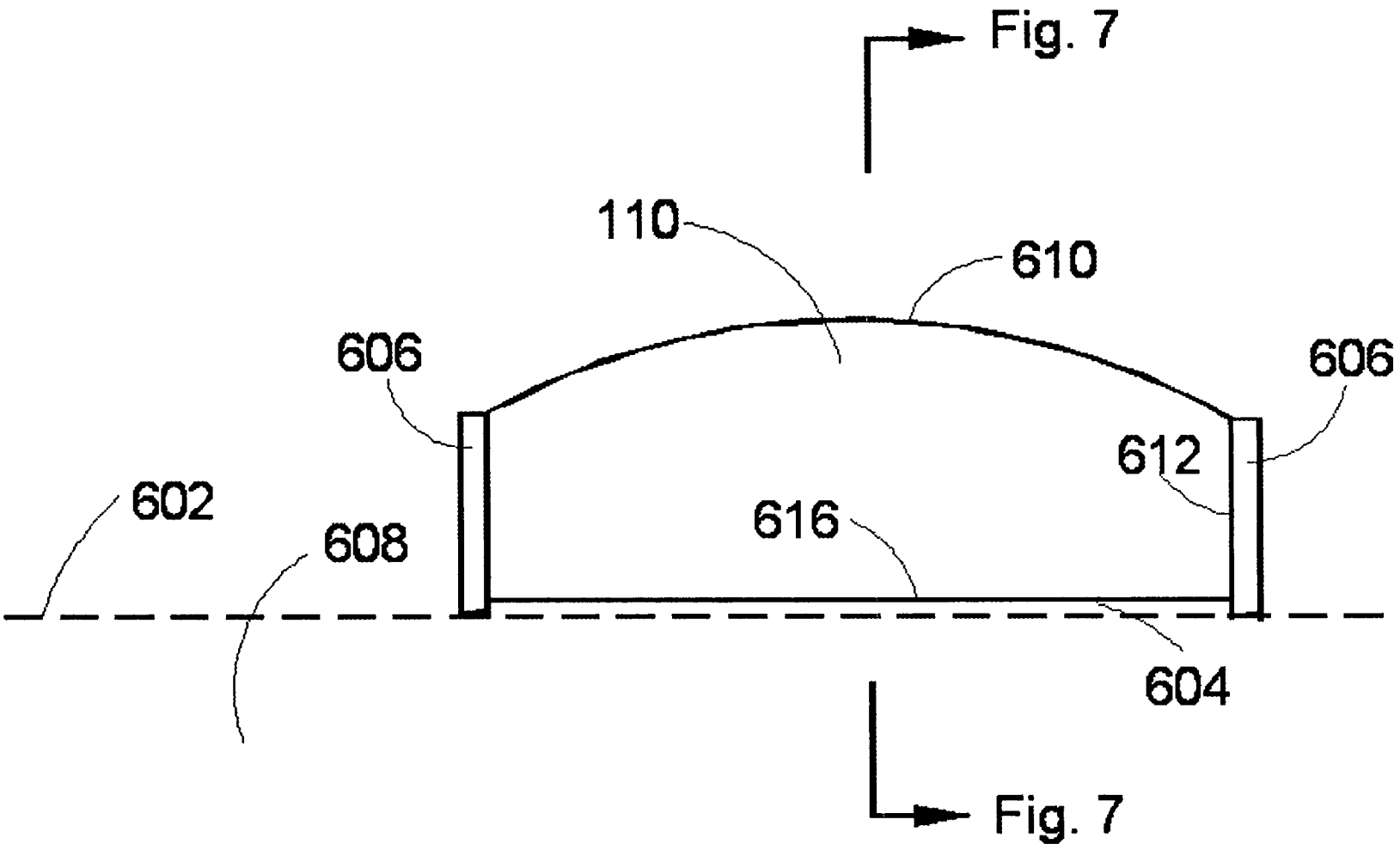
FIG. 6 illustrates a cross-sectional view of a tonal material placed on a woodwind instrument according to one embodiment of the present invention.

Turning now to FIG. 6, illustrated is a tonal material 110 placed on a woodwind instrument. The tonal material 110 may be placed on a member 608 of the woodwind instrument such as a body, key, or any member 608 discussed herein. The tonal material 110 may be placed on a surface 602 of the member 608. There may be an adhesive layer 604 between the bottom surface 616 of the tonal material 110 and the surface 602 of the member 608. There may further be a side wall 606 substantially surrounding the tonal material 110. The side wall 606 may be attached to the surface 602 in any means known in the art, such as by and adhesive, welding, and the like. The side wall 606 may contact a side 612 of the tonal material 110. There may be an adhesive layer (not shown) between the side 612 of the tonal material 110 and the side wall 606. In another embodiment, the side wall 606 may be a part of the member 608. In another embodiment, the tonal material 110 may contact the surface 602 directly without an adhesive layer 604 between the tonal material 110 and the surface 602. The tonal material 110 may be held in place by pressure between the side 612 of the tonal material 110 and the side wall 608. In one particular embodiment, the side wall 608 may be in any shape, for example beveled, curved, welded, with a weld bead, and so forth. The shape of the side wall 608 may also me varied. For example, the side wall 608 may be curved, beveled, include a weld bead, and the like.

The tonal material 110 may have an upper surface 610. The upper surface 610 may be curved, beveled, flat, concave, convex, irregularly shaped, or any other shape. The upper surface 610 of the tonal material 110 may face substantially away from the bottom surface 616 of the tonal material 110.

Figure 7:
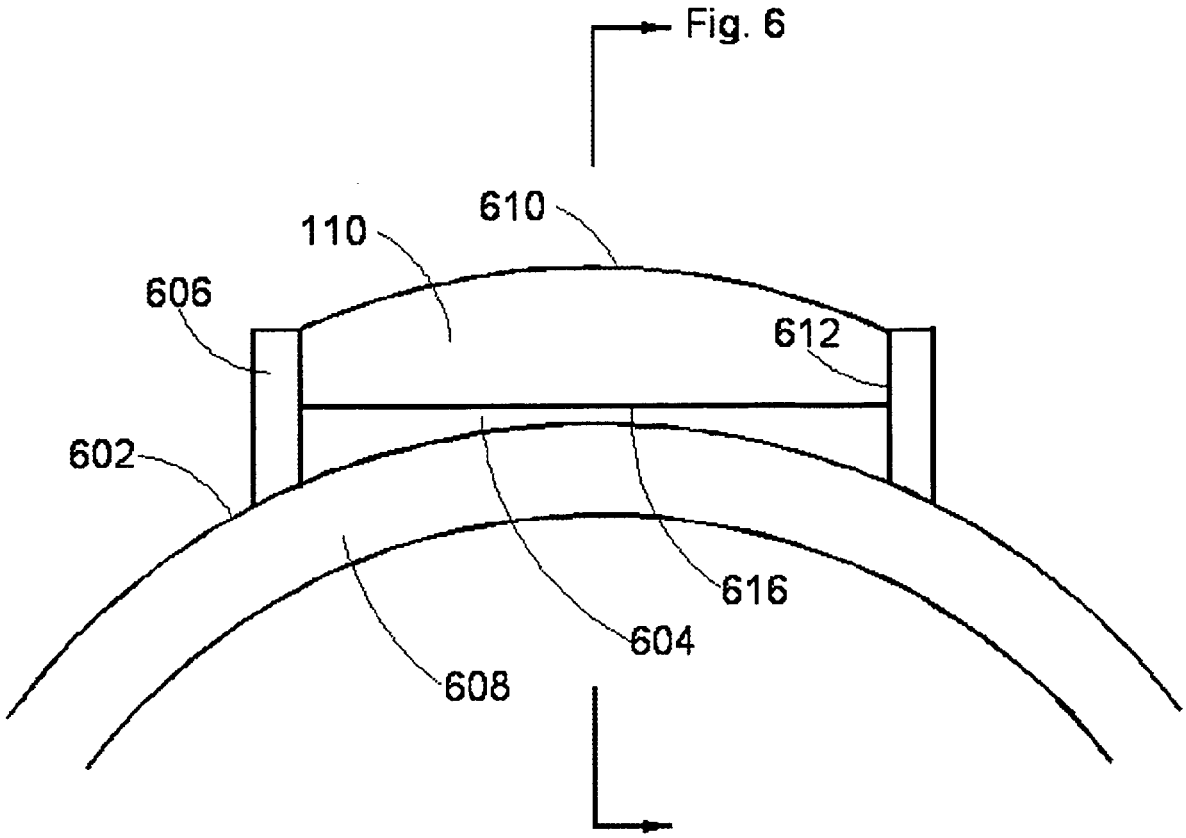
FIG. 7 illustrates a cross-sectional view of a tonal material placed on a woodwind instrument according to one embodiment of the present invention.
Figure 8:
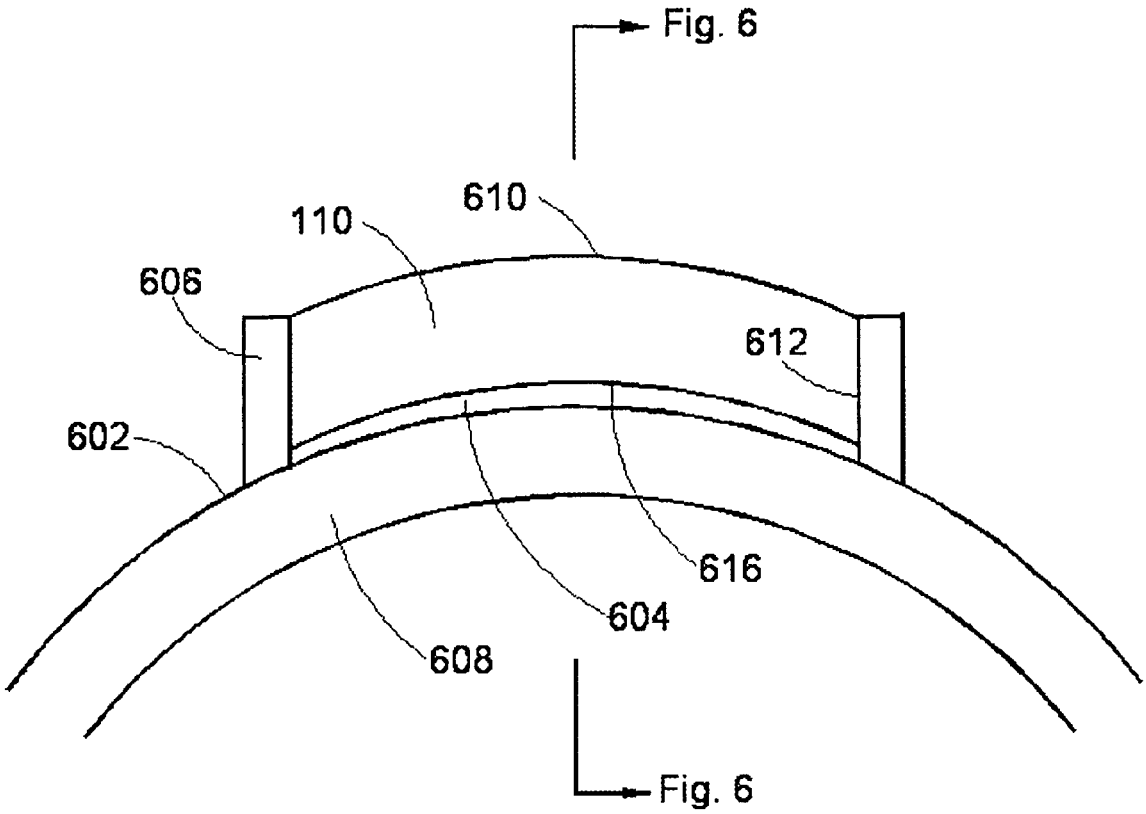
FIG. 8 illustrates a cross-sectional view of a tonal material placed on a woodwind instrument according to one embodiment of the present invention.

Further illustrated in FIGS. 7 and 8 are cross sectional views of the tonal material 110 on a brass instrument of the present invention. FIG. 7 illustrates a concave curved bottom surface 616 of the tonal material 110. FIG. 8 illustrates that the bottom surface 616 of the tonal material 110 may be substantially straight. It is envisioned that this bottom surface 616 may also be convexly curved. In a further embodiment, this bottom surface 616 may contact the surface of the instrument 602 at only one point, or more than one point.

The tonal material may be any material that alters at least one of the tonal characteristics mentioned above. Typically used on keys of woodwind instruments such as saxophones is mother of pearl. In one example, mother of pearl may be placed on the body of the instrument. Mother of pearl, also known as nacre or sadaf, is calcium carbonate platelets with elastic biopolymers (such as chitin, lustrin, or the like). Mother of pearl has a Mohs hardness of from about 2.5 to about 4.5. Other tonal materials of the present invention, may have a Mohs hardness of greater than that of mother of pearl. The tonal materials of one embodiment of the present invention may also be more dense than mother of pearl. Some examples of tonal materials, (and the mohs hardness of some of them) that may be used include semi-precious stones such as garnet (6-7), jasper (6.5-7.5), agate (6.5-7), aventurine (6.5), carnelian (6.5-7), citrine (7), fluorite (4), hematite (5), malachite (3.5-4), obsidian (5-7), onyx (7), tiger's eye (7), turquoise (5-6), unakite (6-7), moonstone (6-6.5), peridot (6.5), jade (6.5-7), alexandrite (7-7.5), amethyst (7), chalcedony (7), quartz (7), aquamarine (7.5-8), lolite (7-7.5), rhodolite (7-7.5), opal (5-6), topaz (8), tourmaline (7-7.5), tanzanite (6.5); precious stones such as diamond (10), emerald (8), sapphire (9), Ceylon sapphire (9), ruby (9), and the like; and other materials such as pumice (6), tungsten carbide (9), steel (6.5), silicon carbide (9), boron carbide (9), strontium titanate (6), emery (7-9), crystolon (9), corundum (9), and the like. In one embodiment, the tonal material is one with a Mohs hardness of at least 6.

EXAMPLES

In order to demonstrate the practice of the present invention, the following examples have been prepared. The examples should not, however, be viewed as limiting the scope of the invention. The claims will serve to define the invention.

Example I

The addition of stones to a saxophone has a dramatic improvement in the various sound qualities of the saxophone. Several tests were performed to illustrate the effect of the sound improvement. The results are summarized in Table 1. The testing involved using a 35670A Hewlett Packard Spectrum Analyzer with sound being recorded through calibrated condenser microphones made y ACO, ¼ inch model 7012 and ½ inch model 7017. The frequency range of the Spectrum Analyzer was set at 0 Hz to 3.2 kHz, which could measure the fundamental tone and the next six overtones or harmonics. Sound was measured in Hz or cycles per second of each fundamental tone and overtones as well as the volume amplitude of each fundamental tone and overtones. The tests were conducted with the results recorded while playing a high B note on a tenor saxophone according to the present invention.

In order to control deviation between tests, each test was conducted using one saxophone by one professional saxophone player playing the same note (high B). The note was played 30 separate times for each of three saxophone configurations. The first configuration was with stones inserted as discussed above. The second set of thirty tests was performed with the stones removed and the third set of thirty tests was performed with the stones replaced with mother of pearl inserts. All tests were performed by the professional saxophone player using the same reed, the same mouthpiece while holding the saxophone in the same position for each test. In addition, the position of the mouth piece relative to the saxophone was precisely monitored to make sure that the same mouthpiece position was used for each test. Furthermore, each test was recorded while playing a fundamental tone of 448 Hz.

As is shown in Table I, the frequency of each overtone, $1^{st}$ through $6^{th}$, is recorded for each of the three saxophone configurations (W meaning with stones, W/O meaning without stones, and MoP meaning with mother-of-pearl). At the bottom of Table 1, the average of each of the thirty tests is provided as well as the average frequency deviation in Hz from that recorded for mother-of-pearl. As shown, each of the overtones were lowered in frequency from 9 Hz at the first overtone to 58 Hz at the sixth overtone.

As previously discussed, the human ear can detect frequency deviations as little as 2 Hz. As such, the saxophone with the stones exhibit a dramatic improvement in sound as each of the overtone frequencies are diminished. The result is that the saxophone overtones become less sharp thus dramatically reducing the saxophone's tendency to sound sharp at the high B note. It should also be noted, that the higher the overtones, the less effect they may have on the perception of the tonal characteristics. That is, if the $19^{th}$ overtone deviates by 2 Hz from standard, the tonal characteristics will not be as negatively affected as if the first or second overtones deviate by 2 Hz from standard. Another aspect that affects the tonal characteristics is the relative volume of the overtones. Overtones that are at least as loud as the fundamental note played have more of an effect on tonal characteristics than do overtones that are not as loud as the fundamental note played.

It is interesting to note that while the primary tone was played at 448 Hz, some of the overtones have a greater amplitude than the primary tone. As such, if the frequency of even one overtone is lowered, it produces an audible change in the sound of the saxophone. In the present case, the sound of the saxophone of the present invention has improved tone quality, focus, clarity, character, warmth, centering of sound and depth. Each of these improvements in the tonal characteristics of the saxophone are a result of the overtones being diminished in frequency to cause the saxophone to become more "true" to the note being played making it easier to play and significantly better sounding.

TABLE I

| | First Overtone | | | Second Overtone | | | Third Overtone | | | Fourth Overtone | | | Fifth Overtone | | | Sixth Overtone | | |
|---|---|---|---|---|---|---|---|---|---|---|---|---|---|---|---|---|---|---|
| Trial | W | W/O | MoP | W | W/O | MoP | W | W/O | MoP | W | W/O | MoP | W | W/O | MoP | W | W/O | MoP |
| 1 | 888 | 896 | 904 | 1328 | 1344 | 1352 | 1776 | 1792 | 1800 | 2216 | 2240 | 2248 | 2664 | 2688 | 2704 | 3104 | 3136 | 3152 |
| 2 | 880 | 888 | 904 | 1320 | 1336 | 1352 | 1760 | 1784 | 1808 | 2200 | 2232 | 2256 | 2640 | 2680 | 2712 | 3088 | 3128 | 3160 |
| 3 | 880 | 896 | 904 | 1328 | 1344 | 1352 | 1768 | 1792 | 1808 | 2208 | 2240 | 2256 | 2648 | 2688 | 2704 | 3088 | 3136 | 3160 |
| 4 | 888 | 896 | 904 | 1328 | 1344 | 1360 | 1776 | 1792 | 1808 | 2216 | 2248 | 2264 | 2664 | 2688 | 2712 | 3104 | 3136 | 3168 |
| 5 | 888 | 888 | 904 | 1328 | 1336 | 1360 | 1776 | 1776 | 1808 | 2224 | 2224 | 2264 | 2664 | 2672 | 2712 | 3112 | 3112 | 3168 |
| 6 | 888 | 896 | 904 | 1336 | 1344 | 1352 | 1784 | 1800 | 1808 | 2224 | 2248 | 2256 | 2672 | 2696 | 2704 | 3120 | 3144 | 3160 |
| 7 | 888 | 896 | 904 | 1336 | 1352 | 1352 | 1560 | 1800 | 1808 | 1784 | 2256 | 2256 | 2220 | 2704 | 2712 | 2672 | 3152 | 3160 |
| 8 | 896 | 896 | 904 | 1344 | 1344 | 1360 | 1784 | 1800 | 1808 | 2232 | 2248 | 2264 | 2680 | 2696 | 2720 | 3128 | 3144 | 3168 |
| 9 | 888 | 904 | 904 | 1336 | 1352 | 1352 | 1784 | 1800 | 1808 | 2232 | 2256 | 2256 | 2680 | 2704 | 2704 | 3120 | 3152 | 3160 |
| 10 | 888 | 896 | 896 | 1336 | 1344 | 1344 | 1784 | 1800 | 1800 | 2224 | 2248 | 2248 | 2672 | 2696 | 2696 | 3120 | 3144 | 3144 |
| 11 | 896 | 904 | 904 | 1344 | 1352 | 1352 | 1792 | 1808 | 1808 | 2240 | 2256 | 2256 | 2688 | 2704 | 2704 | 3136 | 3160 | 3152 |
| 12 | 896 | 896 | 904 | 1344 | 1344 | 1352 | 1792 | 1792 | 1808 | 2240 | 2240 | 2256 | 2688 | 2688 | 2704 | 3136 | 3128 | 3160 |

TABLE I-continued

| | First Overtone | | | Second Overtone | | | Third Overtone | | | Fourth Overtone | | | Fifth Overtone | | | Sixth Overtone | | |
|---|---|---|---|---|---|---|---|---|---|---|---|---|---|---|---|---|---|---|
| Trial | W | W/O | MoP | W | W/O | MoP | W | W/O | MoP | W | W/O | MoP | W | W/O | MoP | W | W/O | MoP |
| 13 | 896 | 896 | 904 | 1344 | 1336 | 1360 | 1552 | 1784 | 1816 | 1784 | 2232 | 2264 | 2232 | 2680 | 2720 | 2680 | 3128 | 3176 |
| 14 | 896 | 896 | 896 | 1344 | 1344 | 1344 | 1792 | 1792 | 1800 | 2240 | 2240 | 2248 | 2688 | 2688 | 2696 | 3128 | 3136 | 3144 |
| 15 | 896 | 904 | 896 | 1344 | 1352 | 1344 | 1792 | 1800 | 1792 | 2232 | 2256 | 2240 | 2680 | 2704 | 2688 | 3128 | 3160 | 3144 |
| 16 | 896 | 896 | 904 | 1344 | 1352 | 1352 | 1792 | 1800 | 1808 | 2232 | 2248 | 2256 | 2680 | 2696 | 2704 | 3128 | 3144 | 3160 |
| 17 | 896 | 896 | 904 | 1344 | 1352 | 1352 | 1792 | 1800 | 1808 | 2240 | 2256 | 2256 | 2688 | 2704 | 2712 | 3136 | 3152 | 3160 |
| 18 | 896 | 904 | 904 | 1344 | 1352 | 1352 | 1792 | 1800 | 1800 | 2240 | 2256 | 2248 | 2688 | 2704 | 2704 | 3128 | 3152 | 3152 |
| 19 | 896 | 904 | 896 | 1344 | 1352 | 1352 | 1792 | 1800 | 1800 | 2240 | 2248 | 2248 | 2688 | 2696 | 2696 | 3136 | 3144 | 3152 |
| 20 | 896 | 896 | 896 | 1344 | 1344 | 1344 | 1792 | 1800 | 1792 | 2240 | 2248 | 2240 | 2688 | 2696 | 2688 | 3136 | 3144 | 3136 |
| 21 | 896 | 896 | 904 | 1344 | 1344 | 1352 | 1792 | 1792 | 1800 | 2240 | 2240 | 2248 | 2688 | 2688 | 2696 | 3136 | 3136 | 3152 |
| 22 | 896 | 904 | 896 | 1344 | 1352 | 1352 | 1792 | 1808 | 1800 | 2240 | 2256 | 2248 | 2688 | 2712 | 2696 | 3136 | 3160 | 3144 |
| 23 | 896 | 896 | 896 | 1344 | 1352 | 1344 | 1792 | 1800 | 1792 | 2248 | 2248 | 2248 | 2696 | 2696 | 2696 | 3144 | 3144 | 3144 |
| 24 | 896 | 904 | 904 | 1344 | 1352 | 1352 | 1792 | 1808 | 1808 | 2240 | 2264 | 2256 | 2688 | 2712 | 2712 | 3136 | 3168 | 3160 |
| 25 | 904 | 904 | 904 | 1352 | 1352 | 1352 | 1800 | 1800 | 1808 | 2256 | 2256 | 2256 | 2704 | 2704 | 2712 | 3152 | 3152 | 3160 |
| 26 | 896 | 904 | 904 | 1352 | 1352 | 1352 | 1800 | 1808 | 1800 | 2248 | 2256 | 2256 | 2696 | 2712 | 2704 | 3152 | 3160 | 3152 |
| 27 | 896 | 896 | 904 | 1344 | 1352 | 1352 | 1792 | 1800 | 1808 | 2240 | 2248 | 2256 | 2688 | 2696 | 2704 | 3136 | 3144 | 3160 |
| 28 | 896 | 904 | 904 | 1344 | 1360 | 1352 | 1792 | 1816 | 1808 | 2240 | 2272 | 2256 | 2688 | 2720 | 2712 | 3136 | 3176 | 3160 |
| 29 | 896 | 904 | 904 | 1344 | 1352 | 1352 | 1792 | 1808 | 1808 | 2240 | 2256 | 2256 | 2688 | 2712 | 2704 | 3128 | 3160 | 3160 |
| 30 | 896 | 904 | 904 | 1352 | 1360 | 1352 | 1800 | 1808 | 1800 | 2248 | 2256 | 2256 | 2696 | 2712 | 2704 | 3144 | 3160 | 3152 |
| AVE | 893 | 899 | 902 | 1341 | 1348 | 1352 | 1773 | 1799 | 1804 | 2204 | 2249 | 2254 | 2651 | 2698 | 2705 | 3098 | 3146 | 3156 |
| HZ | −9 | −3 | — | −11 | −4 | — | −31 | −5 | — | −50 | −5 | — | −54 | −7 | — | −58 | −10 | — |

Example II

In another example, saxophones were again tested using a semi-precious stone instead of mother-of-pearl. All saxophones were tuned to a middle note on the horn, making sure that the horn was in very close proximity to acceptable and standard pitch on that specific note just prior to each testing period. Two problem notes (notes that when played exhibited a higher frequency than what is desired) were then played and tested for pitch using mother-of-pearl on the finger buttons, and again using semi-precious stones on the finger buttons. Each note was played 30 separate times, and the frequency was recorded. The average frequencies for each group of 30 frequencies were calculated. Testing was done by professional musicians. The results are displayed in Table II, where all frequencies are given in Hz.

TABLE II

| | Note Played | Standard Hz | Mother or Pearl Average Hz | Semi-Precious Stone Average Hz |
|---|---|---|---|---|
| Cannonball Alto Saxophone | B | 587.33 | 601.7 | 588.5 |
| | D | 349.23 | 359.0 | 349.6 |
| Cannonball Tenor Saxophone | A | 392.00 | 399.0 | 392.0 |
| | D | 261.63 | 264.6 | 262.5 |
| Selmer Mark VI Tenor Saxophone | A | 392.00 | 396.6 | 392.7 |
| | D | 261.63 | 266.3 | 263.5 |

Example III

In yet another example, a saxophone was tested with mother-of-pearl, with a semi-precious stone, and without a semi-precious stone or mother-of-pearl. In three separate trials, a "C" was played 30 separate times on the saxophone by a professional musician. In the first trial, the saxophone included mother-of-pearl. In the second trial, the saxophone had neither mother-of-pearl nor semi-precious stone. In the third trial, the saxophone had semi-precious stone. On the tests without stone, no mother of pearl was placed on the body. On the tests with the stone, stone was placed on the finger keys as well as on the neck of the saxophone. The testing involved using a 35670A Hewlett Packard Spectrum Analyzer with sound being recorded through calibrated condenser microphones made by ½ inch model 7017. The frequencies of the fundamental note and the next 19 overtones were measured and recorded. The average of the frequency for each of the fundamental note and the next 19 overtones were then averaged, and are shown in Table III, where all numbers are shown in frequency.

TABLE III

| | | With Mother of Pearl | | Without Stone | | With Stone | |
|---|---|---|---|---|---|---|---|
| | Standard | Frequency | Difference from Standard | Frequency | Difference from Standard | Frequency | Difference from Standard |
| Fundamental Note | 304 | 304 | 0 | 304 | 0 | 304 | 0 |
| 1st Overtone | 608 | 624 | 16 | 624 | 16 | 623 | 15 |
| 2nd Overtone | 912 | 932 | 20 | 928 | 16 | 927 | 15 |
| 3rd Overtone | 1216 | 1243 | 27 | 1240 | 24 | 1238 | 22 |

TABLE III-continued

| | | With Mother of Pearl | | Without Stone | | With Stone | |
|---|---|---|---|---|---|---|---|
| | Standard | Frequency | Difference from Standard | Frequency | Difference from Standard | Frequency | Difference from Standard |
| 4th Overtone | 1520 | 1552 | 32 | 1551 | 31 | 1549 | 29 |
| 5th Overtone | 1824 | 1862 | 38 | 1862 | 38 | 1857 | 33 |
| 6th Overtone | 2128 | 2174 | 46 | 2169 | 41 | 2168 | 40 |
| 7th Overtone | 2432 | 2483 | 51 | 2481 | 49 | 2476 | 44 |
| 8th Overtone | 2736 | 2796 | 60 | 2792 | 56 | 2786 | 50 |
| 9th Overtone | 3040 | 3105 | 65 | 3102 | 62 | 3097 | 57 |
| 10th Overtone | 3344 | 3412 | 68 | 3413 | 69 | 3406 | 62 |
| 11th Overtone | 3648 | 3726 | 78 | 3721 | 73 | 3716 | 68 |
| 12th Overtone | 3952 | 4035 | 83 | 4031 | 79 | 4024 | 72 |
| 13th Overtone | 4256 | 4344 | 88 | 4342 | 86 | 4335 | 79 |
| 14th Overtone | 4560 | 4657 | 97 | 4652 | 92 | 4665 | 105 |
| 15th Overtone | 4864 | 4984 | 120 | 4964 | 100 | 4973 | 109 |
| 16th Overtone | 5168 | 5295 | 127 | 5275 | 107 | 5285 | 117 |
| 17th Overtone | 5472 | 5696 | 224 | 5654 | 182 | 5612 | 140 |
| 18th Overtone | 5776 | 5988 | 212 | 5924 | 148 | 5905 | 129 |
| 19th Overtone | 6080 | 6203 | 123 | 6201 | 121 | 6138 | 58 |

In summary, the present application discloses a method and device for manipulating at least one of the tonal characteristics of a woodwind instrument by attaching a tonal material to the woodwind instrument. The tonal material may be any of the above described embodiments. The attachment may be by any method known in the art. In one embodiment, the tonal material is attached using an adhesive. The adhesive may be any known in the art. The adhesive may include a polymer. The adhesive may be contact cement. The adhesive may be placed on the tonal material, and/or the part of the instrument to which the tonal material is to be attached. In another embodiment, the tonal material is attached by threads on the stone and the part of the instrument to which the tonal material is to be attached. There may or may not be a side wall and/or an adhesive as herein described.

It is understood that the above-described embodiments are only illustrative of the application of the principles of the present invention. The present invention may be embodied in other specific forms without departing from its spirit or essential characteristics. The described embodiment is to be considered in all respects only as illustrative and not restrictive. The scope of the invention is, therefore, indicated by the appended claim rather than by the foregoing description. All changes which come within the meaning and range of equivalency of the claims are to be embraced within their scope.

For example, although some of the illustrated embodiments are drawn toward a saxophone, the present invention encompasses any of the woodwind instruments. Some examples of woodwind instrument include: single-reed woodwinds such as arghul, aulochrome, basset horn, clarinet, E-flat clarinet, alto clarinet, bass clarinet, contra-alto clarinet, contrabass clarinet, launeddas, mijwiz, rothphone, sarrusophone, saxophone, soprillo, sopranino saxophone, soprano saxophone, alto saxophone, tenor saxophone, C melody saxophone, baritone saxophone, bass saxophone, contrabass saxophone, subcontrabass saxophone, tubax, tarogato and the like; double-reed woodwinds such as bassanelli, bassoon, contrabassoon, bombarde, duduk, dulcian, dulzania, guan, heckelphone, piccolo heckelphone, hojok, mizmar, nadaswaram, oboe, piccolo oboe, oboe d'amore, English horn, oboe da caccia, racket, shawm, shehnai, suona, surnay, tromboon, trompeta china, zurna, bagpipes, cornamuse, crumhorn, hirtenschalmei, kortholt, rauschpfeife, and the like; and flutes such as bansuri, flute, fife, piccolo, Western concert flute, alto flute, bass flute, contrabass flute, ryuteki, hocchiku, kaval, ney, quena, shakuhachi, flageolet, gemshorn, ocarina, recorder, tin whistle, penny whistle, tonette, and the like.

It is also envisioned that the woodwind instruments may be made of any of a variety of materials. For example, the materials traditionally used to make the woodwind instruments may be used. Alternatively, the instruments may be made of, for example, metals, alloys, plastics, wood, composites, glass, crystalline structures, stone, fibers, and so forth.

It should be noted that in one particular embodiment, the tonal material are naturally-occurring stones, materials and the like. In yet another particular embodiment, the hardness of the naturally occurring tonal materials is greater than that of mother-of-pearl.

Further, although the figures illustrate the tonal material being placed upon the neck and keys, the tonal material may be placed anywhere on the instrument. The tonal material may be placed where it may affect the tonal characteristics. Further still, the tonal material may be attached along a greater circumference of the body than what is illustrated. The tonal material may encircle the entire circumference of the body. For example, the tonal material may be placed around the neck of a saxophone. In yet another embodiment, the tonal material may replace a portion of the body. For example, a portion of the neck may be replaced by a substantially circular section of semi-precious stone in a saxophone. Further, the tonal material may be placed on the inside or outside of the woodwind instrument. For example, if the woodwind instrument has a bell, the tonal material may be placed on the surface of the bell that leads to the inside of the instrument.

The shape of the tonal material may be any contusive to being placed on the part of the woodwind instrument where the tonal material is to be attached. For example, if the tonal material is to be placed on the neck, as illustrated, for example, in FIGS. 1 and/or 2, the tonal material may be in the general shape of an ellipse, oval, circle, triangle, square, rectangle, polygon, torus, and the like. In another example, if the tonal material is placed on a finger key, the tonal material may be in the same general shape as the finger key, such as, for example, circular, ellipsoid, and the like. Further still, if the tonal material is to be placed on a palm key, the tonal material may be in the general shape of a square, rectangle, triangle, circle, ellipse, polygon, or the like.

In yet another embodiment, the tonal material is placed along an outer surface of the body of the woodwind instrument. For example, if the woodwind instrument is a saxophone, the tonal material may be placed on the neck, as shown in FIG. 1, according to this embodiment. The tonal material may be likewise placed anywhere along a surface of the body, such as, for example, the neck, body tube, bell, and/or bow.

Thus, while the present invention has been fully described above with particularity and detail in connection with what is presently deemed to be the most practical and preferred embodiment of the invention, it will be apparent to those of ordinary skill in the art that numerous modifications, including, but not limited to, variations in size, materials, shape, form, function and manner of operation, assembly and use may be made, without departing from the principles and concepts of the invention as set forth in the claims.

What is claimed is:

1. A method of improving the tonal characteristics of a woodwind instrument, comprising the steps of:

identifying a position on a woodwind instrument, wherein placement of a tonal material thereto causes a lowering of overtone amplitude during play, by observing overtone characteristics during play; and attaching a tonal material to the woodwind instrument, at the position.

2. The method of claim 1, wherein the woodwind instrument includes a body having at least one tone hole and a key mechanism attached to a body tube, wherein the step of attaching the tonal material includes attaching the tonal material to one of the group selected from: the body tube and the key mechanism.

3. The method of claim 1, wherein the body tube includes a neck, and the step of attaching the tonal material comprises attaching the tonal material to the neck.

4. The method of claim 3, wherein the tonal material is in the general shape of an oval with a major axis, the neck includes a mouthpiece area for attachment to a mouthpiece, and the step of attaching the tonal material comprises attaching the tonal material such that the major axis is substantially parallel with an axis of the neck.

5. The method of claim 1, further comprising the step of applying an adhesive to one of the group consisting of: the tonal material, the body tube, the key, and combinations thereof.

6. The method of claim 1, further comprising playing a woodwind instrument.

7. A method of improving the tonal characteristics of a woodwind instrument, comprising the steps of:

identifying a position on the woodwind instrument, wherein placement of a tonal material thereto causes a lowering of overtone amplitude during play, by observing overtone characteristics during play;

attaching the tonal material to the woodwind instrument, at the position; and further comprising the step of attaching a housing to the woodwind instrument.

8. The method of claim 7, wherein the tonal material comprises one of the group consisting of: garnet, jasper, agate, aventurine, carnelian, citrine, fluorite, hematite, malachite, obsidian, onyx, tiger's eye, turquoise, unakite, moonstone, peridot, jade, alexandrite, amethyst, chalcedony, quartz, aquamarine, lolite, rhodolite, opal, topaz, tourmaline, tanzanite, diamond, emerald, sapphire, ceylon sapphire, ruby, woodwind, other metals, and combinations thereof.

9. The method of claim 7, wherein the tonal material is not mother-of-pearl.

10. The method of claim 7, further comprising the step of inserting the tonal material into the housing.

11. The method of claim 7, wherein the woodwind instrument comprises one of the group consisting of: arghul, aulochrome, basset horn, clarinet, E-flat clarinet, alto clarinet, bass clarinet, contra-alto clarinet, contrabass clarinet, launeddas, mijwiz, rothphone, sarrusophone, saxophone, soprillo, sopranino saxophone, soprano saxophone, alto saxophone, tenor saxophone, C melody saxophone, baritone saxophone, bass saxophone, contrabass saxophone, subcontrabass saxophone, tubax, tárogáto and the like; double-reed woodwinds such as bassanelli, bassoon, contrabassoon, bombarde, duduk, dulcian, dulzania, guan, heckelphone, piccolo heckelphone, hojok, mizmar, nadaswaram, oboe, piccolo oboe, oboe d'amore, English horn, oboe da caccia, racket, shawm, shehnai, suona, surnay, tromboon, trompeta china, zurna, bagpipes, cornamuse, crumhorn, hirtenschalmei, kortholt, rauschpfeife, and the like; and flutes such as bansuri, flute, fife, piccolo, Western concert flute, alto flute, bass flute, contrabass flute, ryuteki, hocchiku, kaval, ney, quena, shakuhachi, flageolet, gemshorn, ocarina, recorder, tin whistle, penny whistle, and tonette.

12. The method of 7, further comprising playing a woodwind instrument.

13. The method of claim 12, wherein the tonal material comprises one or more of the group consisting of: garnet, jasper, agate, aventurine, carnelian, citrine, fluorite, hematite, malachite, obsidian, onyx, tiger's eye, turquoise, unakite, moonstone, peridot, jade, alexandrite, amethyst, chalcedony, quartz, aquamarine, lolite, rhodolite, opal, topaz, tourmaline, tanzanite, diamond, emerald, sapphire, ceylon sapphire, ruby, woodwind, other metals, and combinations thereof.

14. The method of claim 12, further comprising the step of attaching a housing to the woodwind instrument.

15. The method of claim 12, further comprising the step of inserting the tonal material into the housing.

16. The method of claim 12, wherein the woodwind instrument comprises one of the group consisting of: arghul, aulochrome, basset horn, clarinet, E-flat clarinet, alto clarinet, bass clarinet, contra-alto clarinet, contrabass clarinet, launeddas, mijwiz, rothphone, sarrusophone, saxophone, soprillo, sopranino saxophone, soprano saxophone, alto saxophone, tenor saxophone, C melody saxophone, baritone saxophone, bass saxophone, contrabass saxophone, subcontrabass saxophone, tubax, tarogato and the like; double-reed woodwinds such as bassanelli, bassoon, contrabassoon, bombarde, duduk, dulcian, dulzania, guan, heckelphone, piccolo heckelphone, hojok, mizmar, nadaswaram, oboe, piccolo oboe, oboe d'amore, English horn, oboe da caccia, racket, shawm, shehnai, suona, surnay, tromboon, trompeta china, zurna, bagpipes, cornamuse, crumhorn, hirtenschalmei, kortholt, rauschpfeife, and the like; and flutes such as bansuri, flute, fife, piccolo, Western concert flute, alto flute, bass flute, contrabass flute, ryuteki, hocchiku, kaval, ney, quena, shakuhachi, flageolet, gemshorn, ocarina, recorder, tin whistle, penny whistle, and tonette.

17. A method of improving the tonal characteristics of a woodwind instrument, comprising the steps of:

identifying a position on the woodwind instrument, wherein placement of a tonal material thereto causes a lowering of overtone amplitude during play, by observing overtone characteristics during play;

positioning the tonal material to the woodwind instrument;

measuring the overtone amplitude;

playing the woodwind instrument; and repositioning the tonal material to optimal overtone amplitude position; and attaching the tonal material to the woodwind instrument, at the optimal overtone amplitude position.

* * * * *